US006491058B1

(12) United States Patent
Wang

(10) Patent No.: US 6,491,058 B1
(45) Date of Patent: Dec. 10, 2002

(54) STRUCTURE FOR LOCATING WATER MIXING BOLT OF LAVATORY FAUCET

(76) Inventor: Shih-Ming Wang, P.O. Box 453, Taichung (TW)

( * ) Notice: Subject to any disclaimer, the term of this patent is extended or adjusted under 35 U.S.C. 154(b) by 0 days.

(21) Appl. No.: 09/877,089

(22) Filed: Jun. 11, 2001

(51) Int. Cl.[7] ..... E03C 1/04
(52) U.S. Cl. ..... 137/359; 4/673; 137/606; 137/801
(58) Field of Search ..... 4/673; 137/359, 137/606, 801

(56) References Cited

U.S. PATENT DOCUMENTS 5,232,008 A * 8/1993 Jeffress et al. ..... 137/359
6,256,810 B1 * 7/2001 Baker ..... 4/678
6,360,770 B1 * 3/2002 Buchner et al. ..... 137/359
6,381,776 B1 * 5/2002 Wang ..... 137/801
6,401,748 B1 * 6/2002 Wang ..... 137/359

* cited by examiner

*Primary Examiner*—Gerald A. Michalsky
(74) *Attorney, Agent, or Firm*—Harrison & Egbert

(57) ABSTRACT

A lavatory faucet comprises a connection pipe, a water mixing bolt seat mounted on the connection pipe, a fastening board movably located over the water mixing bolt seat, a water mixing bolt tube, a locating bolt, and a faucet neck mounted on the lavatory basin and engaged with the locating bolt and the water mixing bolt tube which is located by the fastening board pressing against the lavatory basin.

1 Claim, 5 Drawing Sheets

STRUCTURE FOR LOCATING WATER MIXING BOLT OF LAVATORY FAUCET

BACKGROUND OF THE INVENTION

1. Field of the Invention

The present invention relates generally to a lavatory faucet, and more particularly to a structure for locating securely the water mixing bolt of the lavatory faucet.

2. Description of Related Art

As shown in FIG. 1, a lavatory faucet of the prior art is fastened with the lavatory basin 16 in conjunction with a cold water control valve 10 and a hot water control valve 11, which are connected by a connection pipe 13. The cold water control valve 10 is connected with a cold water pipe 14 while the hot water control valve 11 is connected with a hot water pipe 15. The water pipes 14 and 15 are respectively put through the mounting hole 17 of the basin 16 along with a locating board 18, and a locking ring 19. The faucet neck 20 is fastened with a lug 22 by a fastening bolt 21. Located between the faucet neck 20 and the basin 16 is a cover board 23. The locating board 18 and the locking ring 19 are located at the bottom of the basin 16 such that they can be hardly reached by hand or hand tool. As a result, it is difficult to loosen the locking ring 19 so as to separate the faucet neck 20 from the basin 16 in the event that the lavatory faucet is to be replaced.

BRIEF SUMMARY OF THE INVENTION

The primary objective of the present invention is to provide a lavatory faucet which can be easily unfastened with a lavatory basin to which the lavatory basin is fastened.

The lavatory faucet of the present invention comprises a water mixing bolt seat, a fastening board, a water mixing bolt tube, a locating bolt, and a faucet neck. The water mixing bolt seat is mounted between the cold water control valve and the hot water control valve along with the fastening board. The water mixing bolt seat is located securely in place by the fastening board which is pressed against the lavatory basin. The lavatory neck is located by the locating bolt.

The features and the functions of the present invention will be more readily understood upon a thoughtful deliberation of the following detailed description of the present invention with reference to the accompanying drawings.

DETAILED DESCRIPTION OF THE INVENTION

Figure 1:
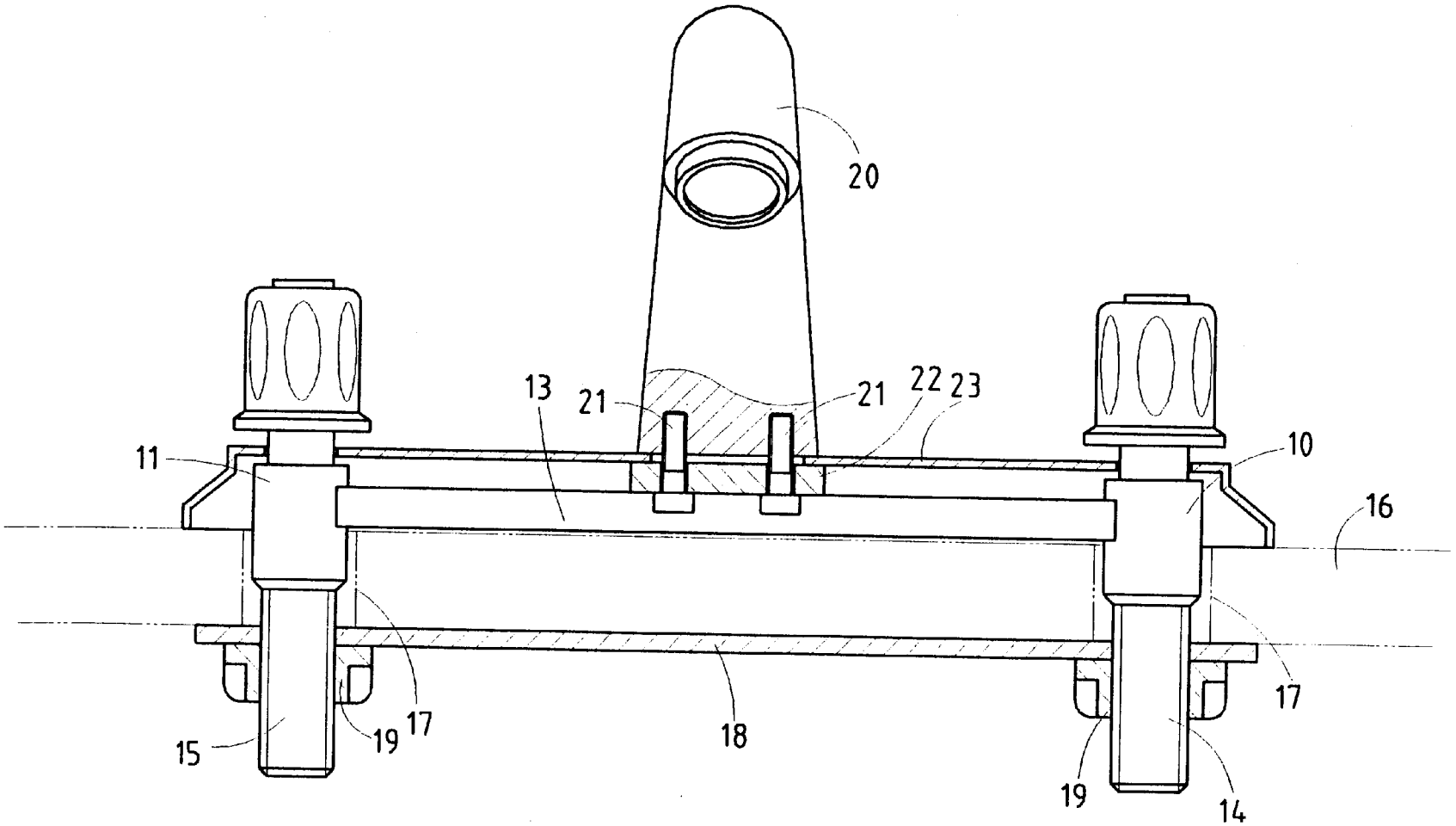
FIG.1 PRIOR ART
FIG. 1 shows a sectional schematic view of a lavatory faucet of the prior art mounted on the lavatory.
Figure 2:
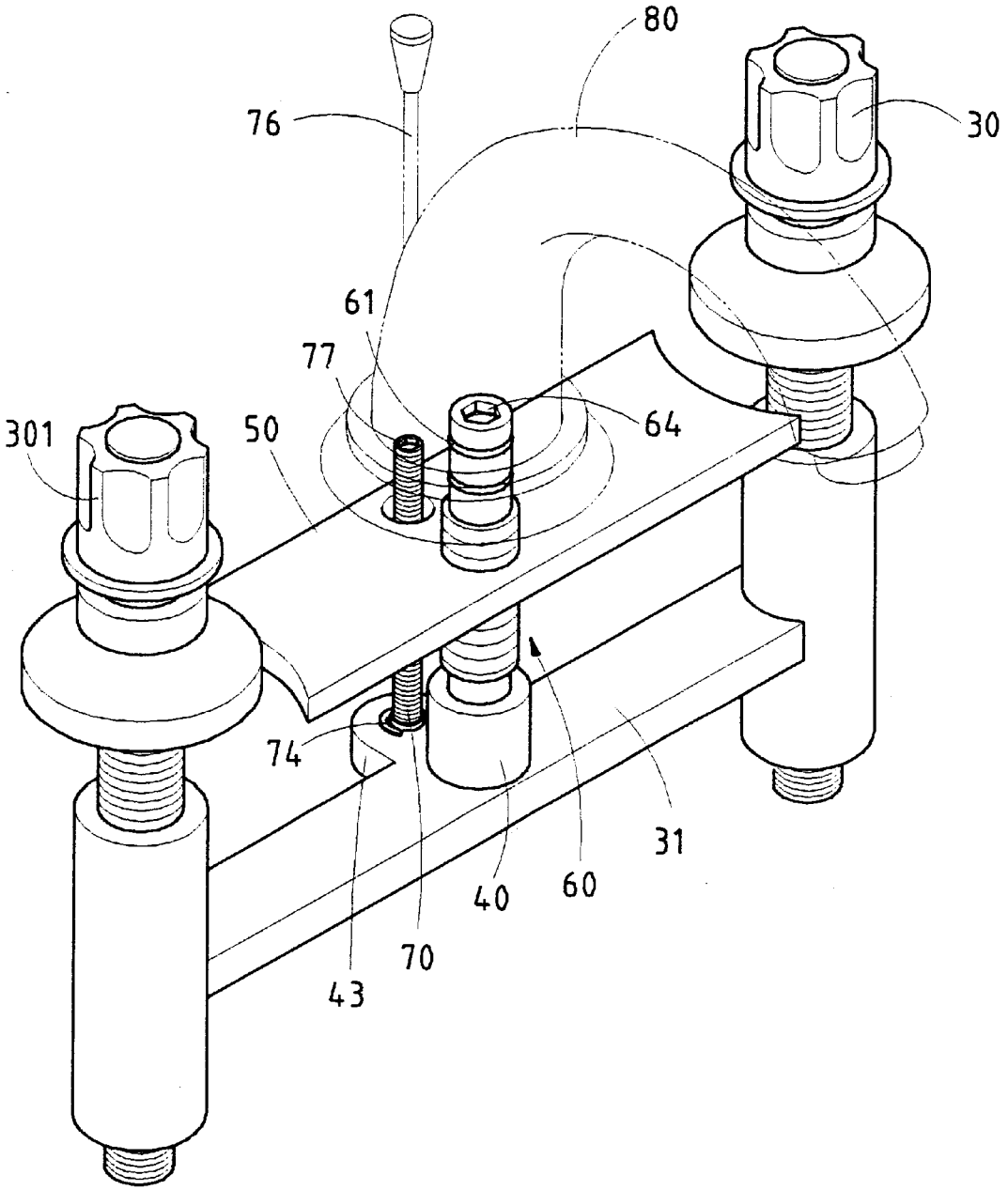
FIG. 2 shows a perspective view of a lavatory faucet of the present invention.
Figure 3:
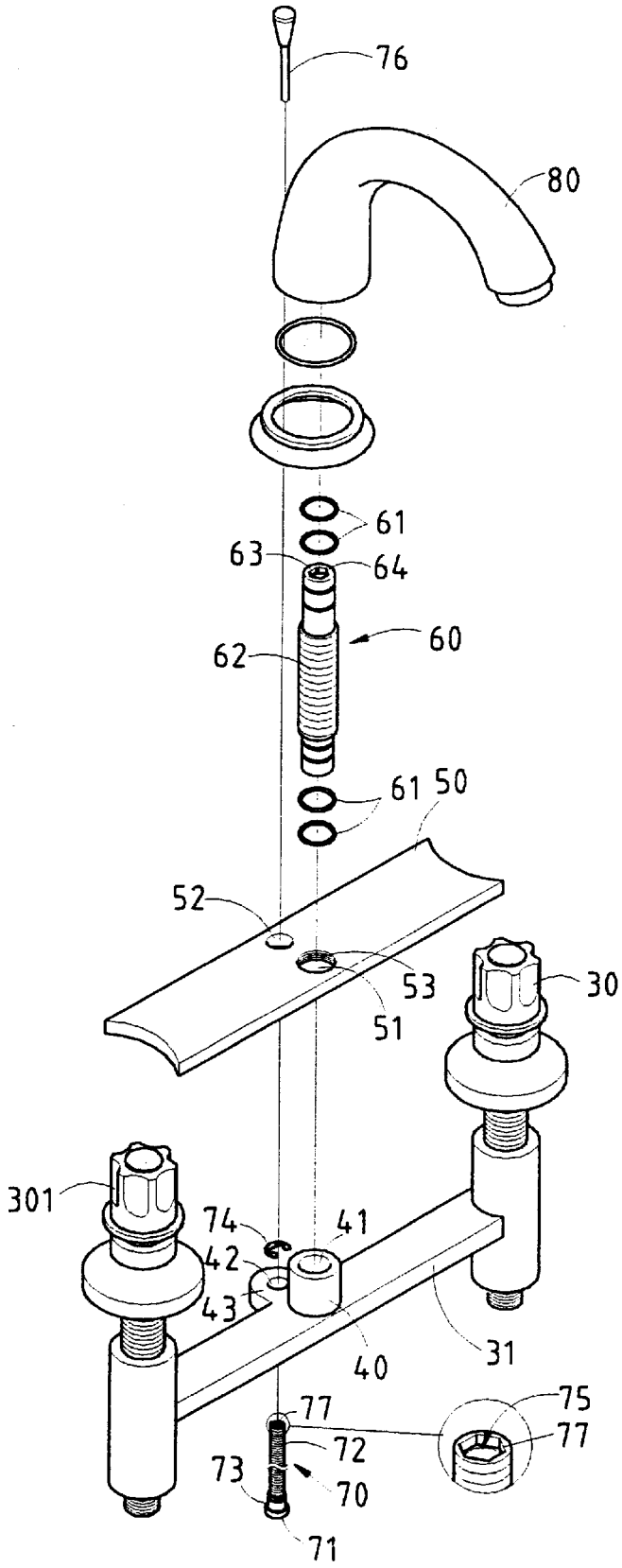
FIG. 3 shows an exploded view of the lavatory faucet of the present invention.
Figure 4:
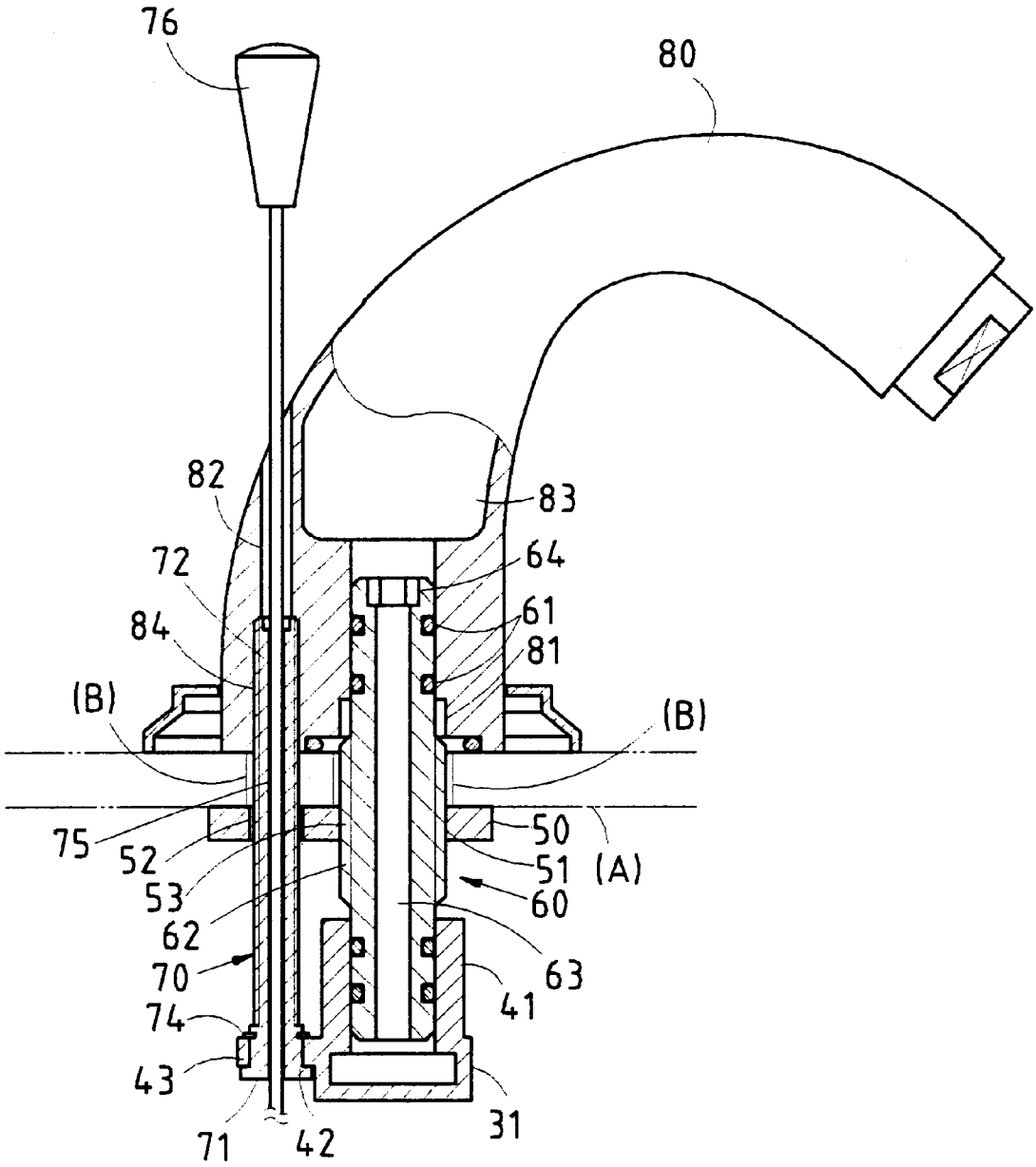
FIG. 4 shows a side sectional view of the lavatory faucet of the present invention in combination.
Figure 5:
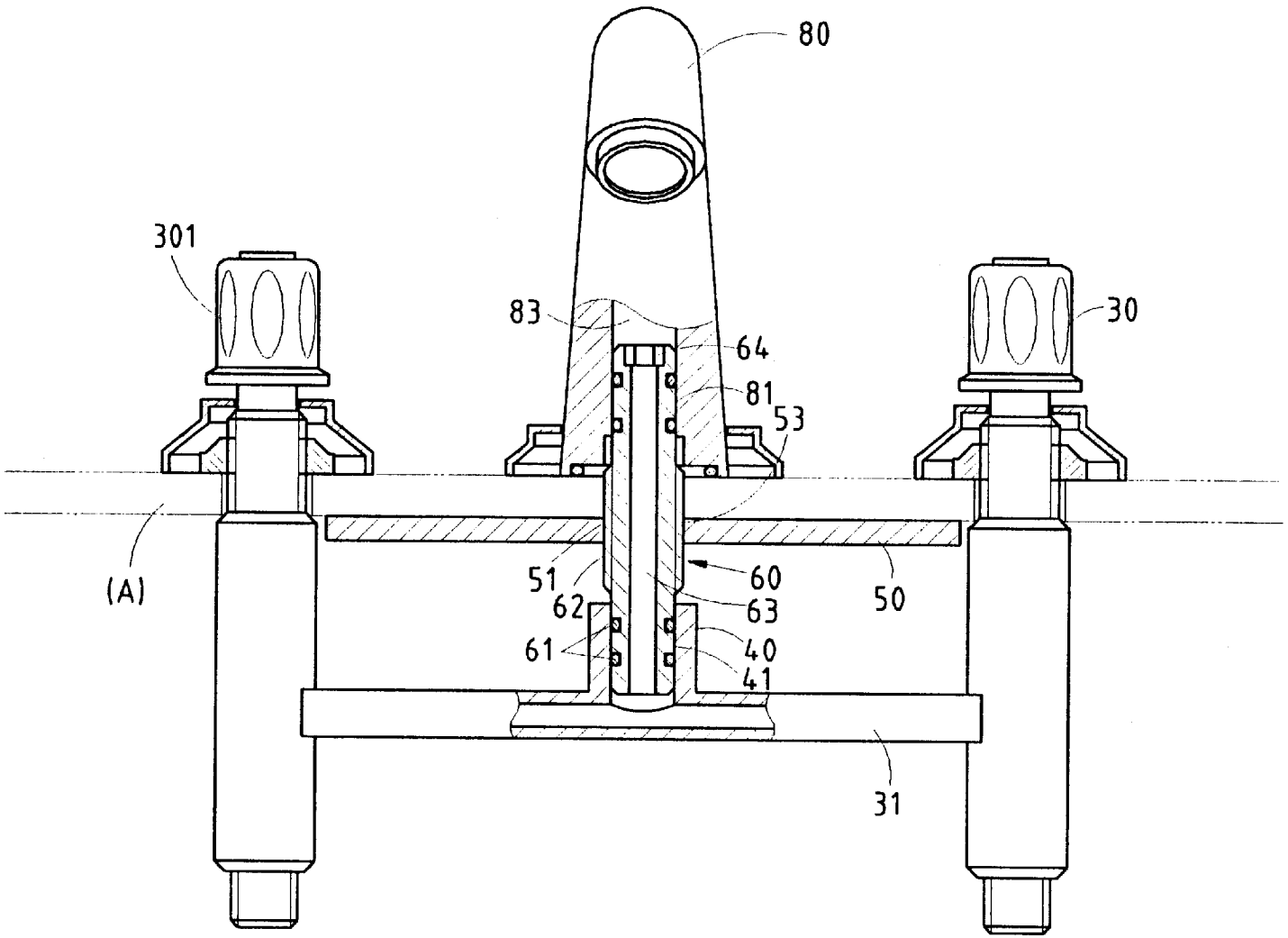
FIG. 5 shows a front sectional view of the lavatory faucet of the present invention in combination.

As shown in FIGS. 2–5, a lavatory faucet of the present invention comprises a water mixing bolt seat 40, a fastening board 50, a water mixing bolt tube 60, a locating bolt 70, and a faucet neck 80.

The water mixing bolt seat 40 is mounted on a connection pipe 31 which is connected with a cold water control valve 30 and a hot water control valve 301. The water mixing bolt seat 40 is provided at the top end with a receiving hole 41. The connection pipe 31 is provided with a lug 43 which is corresponding in location to the water mixing bolt seat 40 and is provided with a through hole 42. The water mixing bolt seat 40, the connection pipe 31, and the lug 43 of the connection pipe 31 are made integrally such that the receiving hole 41 of the water mixing bolt seat 40 is in communication with the connection pipe 31.

The fastening board 50 is provided with a first through hole 51 with inner threads 53, and a second through hole 52. The fastening board 50 is disposed over the water mixing bolt seat 40 such that the first through hole 51 is in alignment with the receiving hole 41 of the water mixing bolt seat 40, and that the second through hole 52 is aligned with the through hole 42 of the lug 43 of the connection pipe 31.

The water mixing bolt tube 60 is provided with an outer threaded segment 62, and a longitudinal through hole 63 which is provided at the top end with a fitting slot 64 engageable with a hand tool. The water mixing bolt tube 60 is put through a mounting hole "B" of the lavatory basin "A" such that the bottom end of the water mixing bolt tube 60 is received in the receiving hole 41 of the water mixing bolt seat 40 via the first through hole 51 of the fastening board 50, and that the outer threaded segment 62 of the water mixing bolt tube 60 is engaged with the inner threads 53 of the first through hole 51 of the fastening board 50. As the water mixing bolt tube 60 is turned by the hand tool engaging the fitting slot 64 of the tube 60, the fastening board 50 is moved upwards to press against the bottom edge of the mounting hole "B" of the lavatory basin "A". The tube 60 is provided at both longitudinal ends with a plurality of washers 61.

The locating bolt 70 has a head 71, a threaded shank 72, a retaining groove 73 located between the head 71 and the shank 72, and a longitudinal through hole 75. The through hole 75 is provided in one end with a fitting slot 77 opposite in location to.the head 71 and engageable with a hand tool. A lift rod 76 of the lavatory basin "B" is put through the through hole 75 of the locating bolt 70. The locating bolt 70 is received in the through hole 42 of the lug 43 of the connection pipe 31 in conjunction with a retaining ring 74 which is retained in the retaining groove 73 of the locating bolt 70.

The faucet neck 80 is provided in the bottom end with a connection slot 81, a locating slot 82 with inner threads 84, and a water discharging duct 83 in communication with the connection slot 81. The faucet neck 80 is mounted on the lavatory basin "A" such that the inner threads 84 of the locating slot 82 are engaged with the threaded shank 72 of the locating bolt 70, and that the top end of the water mixing bolt tube 60 is received in the connection slot 81 of the faucet neck 80, and further that the water discharging duct 83 of the faucet neck 80 is in communication with the connection slot 81 and the longitudinal through hole 63 of the water mixing bolt tube 60.

The lavatory faucet of the present invention can be easily removed from the lavatory basin by a hand tool, which is engaged with the fitting slot 77 of the locating bolt 70 and the fitting slot 64 of the water mixing bolt tube 60.

The present invention described above is to be regarded in all respects as being merely illustrative and not restrictive. Accordingly, the present invention may be embodied in other specific forms without deviating from the spirit thereof The present invention is therefore to be limited only by the scope of the following claim.

I claim:

1. A lavatory faucet comprising:

a lavatory basin having a mounting hole formed therein;

a cold water control valve;

a hot water control valve;

a connection pipe having one end connected to said cold water control valve and an opposite end connected to said hot water control valve, said connection pipe having a lug formed thereon, said lug having a through hole extending therethrough;

a water mixing bolt seat mounted on said connection pipe adjacent to said lug, said water mixing bolt seat having a receiving hole in fluid communication with said connection pipe;

a fastening board having a first through hole and a second through hole, said first through hole being threaded, said fastening board being adjustably disposed over said water mixing bolt seat such that said first through hole is aligned with said receiving hole of said mixing bolt seat and such that said second through bole is aligned with said through hole of said lug;

a water mixing bolt tube having an outer threaded segment and a longitudinal through hole, said longitudinal through hole having a fitting slot formed therein, said water mixing bolt tube having a socket engageable with a hand tool, said water mixing bolt tube extending through said mounting hole of said lavatory basin and through said first through hole of said fastening board, a bottom end of said water mixing bolt tube being received in said receiving hole of said water mixing bolt seat, said outer threaded segment being threadedly engaged with said first through hole of said fastening board such that said fastening board is movable upwardly so as to press against a surface of said lavatory basin when said water mixing bolt tube is rotated by the hand tool;

a locating bolt having a head at one end and a threaded shank with a retaining groove formed thereon, said locating bolt having a longitudinal through hole with a fitting slot formed in an opposite end thereof, said fitting slot of said locating bolt being engagable with the hand tool, said locating bolt received in said through hole of said lug of said connection pipe and extending through said second through hole of said fastening board, said locating bolt having a retaining ring received in said retaining groove; and a faucet neck having a connection slot formed in a bottom end thereof, said faucet neck having a locating slot formed therein and having inner threads, said faucet neck having a water discharging duct in communication with said connection slot, said faucet neck being mounted on said lavatory basin, said inner threads of said locating slot being threadedly engaged with said threaded shank of said locating bolt, said water mixing bolt tube having a top end received in said connection slot of said faucet neck, said water discharging duct of said faucet neck being in communication with said connection slot and said longitudinal through hole of said water mixing bolt tube.

* * * * *